US005913592A

United States Patent [19]

Moore

[11] Patent Number: 5,913,592

[45] Date of Patent: Jun. 22, 1999

[54] PERFORMANCE WATER SPORT BOOT

[75] Inventor: Bruce Yin Moore, Santa Cruz, Calif.

[73] Assignee: O'Neill, Inc., Santa Cruz, Calif.

[21] Appl. No.: 08/972,800

[22] Filed: Nov. 18, 1997

Related U.S. Application Data

[63] Continuation of application No. 08/735,801, Oct. 21, 1996, abandoned.

[51] Int. Cl.[6] ..... A43B 5/08

[52] U.S. Cl. ..... 36/8.1; 36/4; 36/94; 36/58.5

[58] Field of Search ..... 36/102, 103, 4, 36/8.1, 94, 68, 69, 58.5

[56] References Cited

U.S. PATENT DOCUMENTS

| | | | |
|---|---|---|---|
| 2,121,907 | 6/1938 | Easton | 36/4 |
| 2,129,226 | 9/1938 | Montano | 36/8.1 |
| 3,013,564 | 12/1961 | Levey | 128/611 |
| 4,294,022 | 10/1981 | Stockli et al. | 36/4 |

OTHER PUBLICATIONS

Photographs of a Bootie by O'Neill, Inc. Figures 1–6 (3 sheets).

*Primary Examiner*—Ted Kavanaugh
*Attorney, Agent, or Firm*—Flehr Hohbach Test Albritton & Herbert LLP

[57] ABSTRACT

A water sport boot (10) having an upper (12), a resiliently compressible sole pad (14), a stretchable heel cup (16), an adjustable strap (18), an achilles panel (20), toe box foxing (22), and an elastic leg band (92). Heel cup (16) and adjustable strap (18) cooperate to seal off the heel and ankle region of the upper in order to prevent water from entering the instep region (26) of upper (12). Sole pad (14) is made of a relatively thin, resiliently compressible material that easily and quickly conforms to the contour of the surface being stepped on in order to provide good tactile sensation. Sole pad (14) also has a corrugated rib pattern on its exterior underside to increase traction.

21 Claims, 3 Drawing Sheets

PERFORMANCE WATER SPORT BOOT

This is a continuation of application Ser. No. 08/735,801 filed Oct. 21, 1996 now abandoned.

TECHNICAL FIELD

The present invention pertains to equipment for water sports and more particularly to boots or "booties," which typically are worn by surfers for protection and to improve traction.

BACKGROUND OF THE INVENTION

Water sport boots are worn by athletes and recreational enthusiasts in a variety of sports, some of which include surfing, windsurfing, jet skiing, sailing and diving. People wear water sport boots for a variety of reasons but from a performance standpoint, they wear boots primarily to improve traction. A properly designed boot can significantly increase a person's ability to gain traction on, for example, a surfboard or sailboard. Water sport boots are worn for other reasons as well. Boots protect the skin of the foot from abrasions, which in the sport of windsurfing is often necessary. Water sport boots also act as insulators, protecting the feet from heat loss in cold water activities. In addition, water sport boots provide protection for the soles of the feet. Stepping across rocks, coral, loose gravel and other irregular surfaces can be uncomfortable, whether these obstacles are in or out of the water. Boots with stiff soles provide protection when traversing these types of terrain. It is also desirable, of course, for a water sport boot to be durable enough to withstand the use and abuse normally associated with various water sports.

Known methods and techniques for improving a boot's ability to protect against abrasion, or to protect the soles of a person's feet, or to insulate the feet, or to make a boot more durable, all have a tendency to adversely affect boot performance. For example, making the boot from a thicker material increases its ability to insulate the feet, and providing the bottom of the boot with a stiff sole pad helps to protect the soles of the feet, but both designs tend to decrease the boot's ability to grip the surface of a board or deck or otherwise provide traction.

Water sport boots with relatively thin sole pad material, which is resilient and compressible and preferably has a roughened or contoured surface, are known to provide good traction. When used, however, these boots typically tend to fill with water, which has the advantage of insulating the foot once the water is warmed near to body temperature, but has the disadvantage of providing poor gripping traction because the water causes the foot to slide within the boot. The problem is made worse if the boot is provided with a well roughened or irregularly contoured sole pad that is designed to provide enhanced traction. With such a boot, the sole pad grips very well the surface of a surfboard, for example, while the foot slides around within the boot.

Providing a water sport boot with a stiff sole pad tends to minimize slipping of the foot within the boot. However, a boot with a stiff sole pad tends to negatively affect the boot's performance because the stiff sole pad cannot bend or flex to match the contour of an object being stepped on. For certain water sports, it is important for the feet to sense what is being stepped on in order to provide feedback to the person. For example, in the sport of surfing, a surfer is continually repositioning his or her feet during turns and cut-backs, and when doing aerial maneuvers. Stiff boots work well and provide satisfactory feedback for a variety of conditions, but for high performance surfing, they have their disadvantages.

Accordingly, it is an object of the present invention to enhance a person's ability to grip the surface of a board, deck, or other object while performing maneuvers normally associated with water sports and water activities.

DISCLOSURE OF THE INVENTION

Briefly described, the present invention comprises a performance water sport boot having a resiliently compressible upper that includes an instep region and a collar region, with the instep region adapted to conform to a person's foot and ankle and the collar region adapted to conform to the person's lower leg. A sole pad is mounted to the underside and side edge portions of the instep region. The sole pad is made from a material that is less compressible than the upper's material, yet which has sufficient flexibility and compressibility to conform to the contour of an object being stepped on by the person and to transmit tactile sensations of the contour to the person's foot. A heel cup is mounted around the heel portion of the upper. The heel cup extends around at least partially to the sides of the upper, and an adjustable strap is provided that extends above the instep region and is secured to the sides of the heel cup. The adjustable strap tightens the upper around the heel and ankle of the person's foot in order to prevent water from seeping into the instep region of the upper, as well as to anchor the boot to the heel of the foot.

The provision of a sole pad that is made from relatively flexible and compressible material increases the traction of the boot and the provision of the heel cup and strap prevents water from seeping into the instep region of the upper, which if allowed to occur, would cause the person's foot to slip within the boot due to the flexible nature of the sole pad. With a resiliently compressible sole pad and an otherwise sealed-off upper, the boot of the present invention provides enhanced performance while minimizing foot slippage.

The sole pad is made from a material that is sufficiently flexible and compressible so that the boot can provide tactile sensations to the person's foot as nearly as if the person were barefoot. At the same time, the flexible nature of the sole pad along with the roughened corrugated pattern formed in the sole pad provides excellent gripping traction.

In some high performance activities, it is important that the heel, ball, and toes, and even the lateral margin of a person's foot be able to independently provide feedback from the object being stepped on. By making the sole pad out of relatively flexible, compressible material, the sole pad does not insulate feedback from any particular region of the boot. In other words, feedback is provided from all regions of the foot. Preferably, the sole pad is made from a rubber-like material that has no greater than a 35 shore rating. It has been found that a 30 shore rated natural rubber sole pad works well.

According to an aspect of the invention, the heel cup is made from a material having sufficient flexibility to conform to the heel of the person's foot, yet also has sufficient strength in tension to tighten around a person's heel and prevent water from seeping into the instep region of the upper. Preferably, the heel cup is made from a netting material, such as nylon netting. A nylon netting material is a relatively lightweight material and it firmly and more evenly distributes pressure from the adjustable strap around the heel. This improves the boots ability to seal off the ankle region of the boot, and also improves the fit of the boot for various foot sizes.

According to another aspect of the invention, the adjustable strap includes hook and loop fasteners and is fixedly secured to one side of the heel cup while being looped through the other side. In this manner, the adjustable strap can be easily adjusted and secured in position to tighten the upper around the heel and ankle. Preferably, the free end of the adjustable strap includes a pull tab, which is easily grabbed to detach the adjustable strap so that the strap can be readjusted or a person can take off the boot.

According to another aspect of the invention, an achilles panel is mounted to the back side and lower side edge portions of the upper. The achilles panel is made from a material significantly stronger than the sole pad. Preferably the achilles panel is made from 60 shore natural rubber. The heel cup is at least partially sandwiched and secured between the achilles panel and the upper. This design provides good protection for the achilles tendon while at the same time allowing the upper to conform to the heel and ankle to seal off the instep region of the upper.

According to another aspect of the invention, the upper includes at least one cut-out in the toe box of the upper. This creates a split toe box having separate pockets for receiving toes of the person. The sections of the upper that form the cut-out in the toe box are not padded with additional material, as they are in some prior art blots. Only the resiliently compressible upper material separates the person's toes. Elimination of additional padding material decreases the weight of the boot and is more comfortable for the person.

According to another aspect of the invention, a toe box foxing is mounted over the toe box region of the upper. The toe box foxing is made from a material significantly stronger than the sole pad and preferably is made from 50 shore natural rubber. The toe box foxing material provides protection to the person's toes from normal bangs and bumps encountered in water sport activities. Preferably, the toe box foxing includes slits that generally are aligned with the gaps between the person's toes. The slits give the toe box foxing additional lateral flexibility for increased comfort and tactile sensation.

According to another aspect of the invention, an elastic leg band is secured around the collar portion of the upper. Preferably the elastic leg band is a stretch Lycra tape. The Lycra tape prevents over-stressing of the seams in the upper and also grips the leg above the ankle to prevent a significant quantity of water from getting down into the collar region of the upper.

These and other features, advantages and objects of the present invention will become apparent from the following description of the Best Mode for Carrying Out the Invention, when read in conjunction with the accompanying drawings, and the claims, which are all incorporated herein as part of the disclosure of the invention.

BRIEF DESCRIPTION OF THE DRAWINGS

In the drawings, like reference numerals refer to like parts throughout the several views, wherein.

BEST MODE FOR CARRYING OUT THE INVENTION

Figure 1:
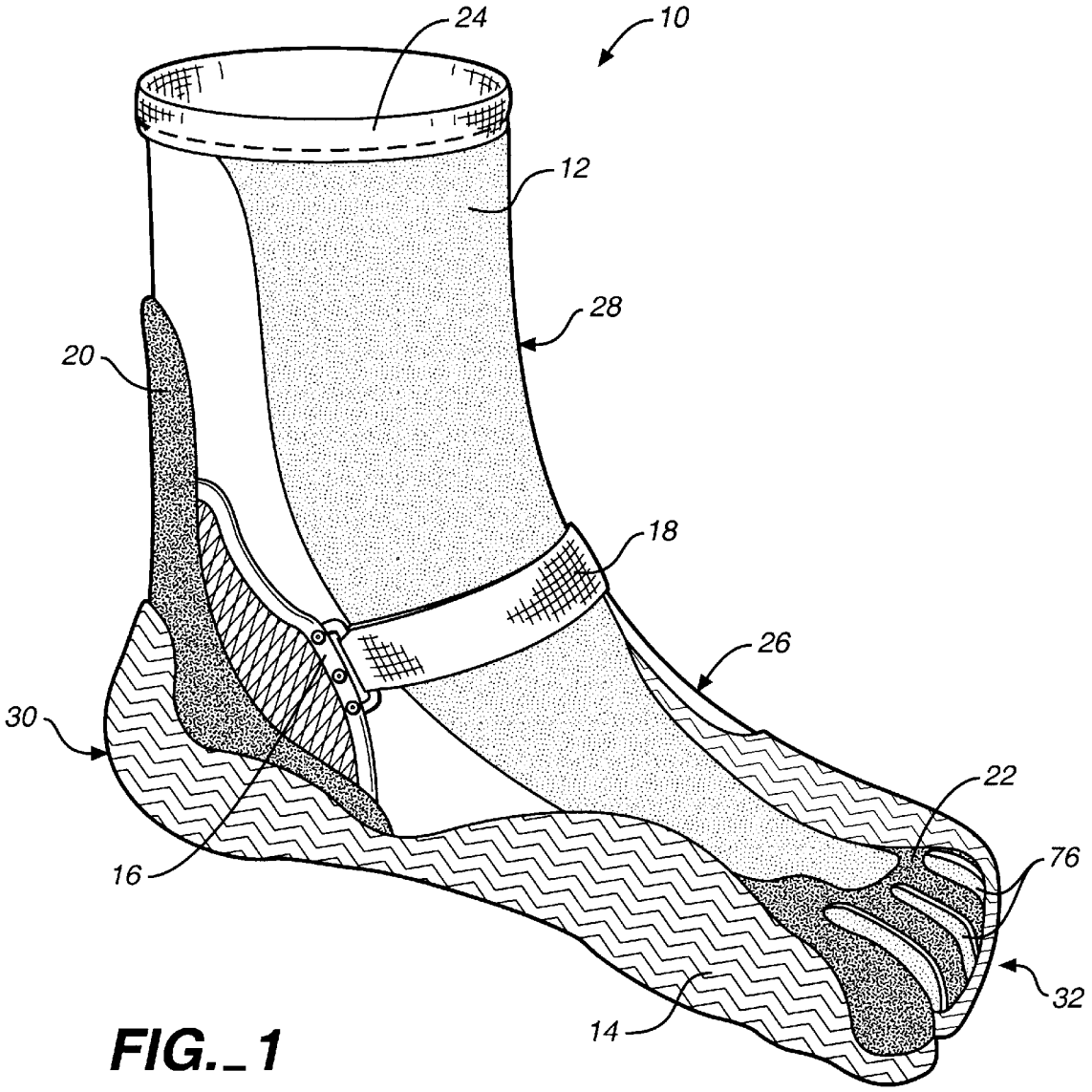
FIG. 1 is a pictorial view of the water sport boot of the present invention.
Figure 2:
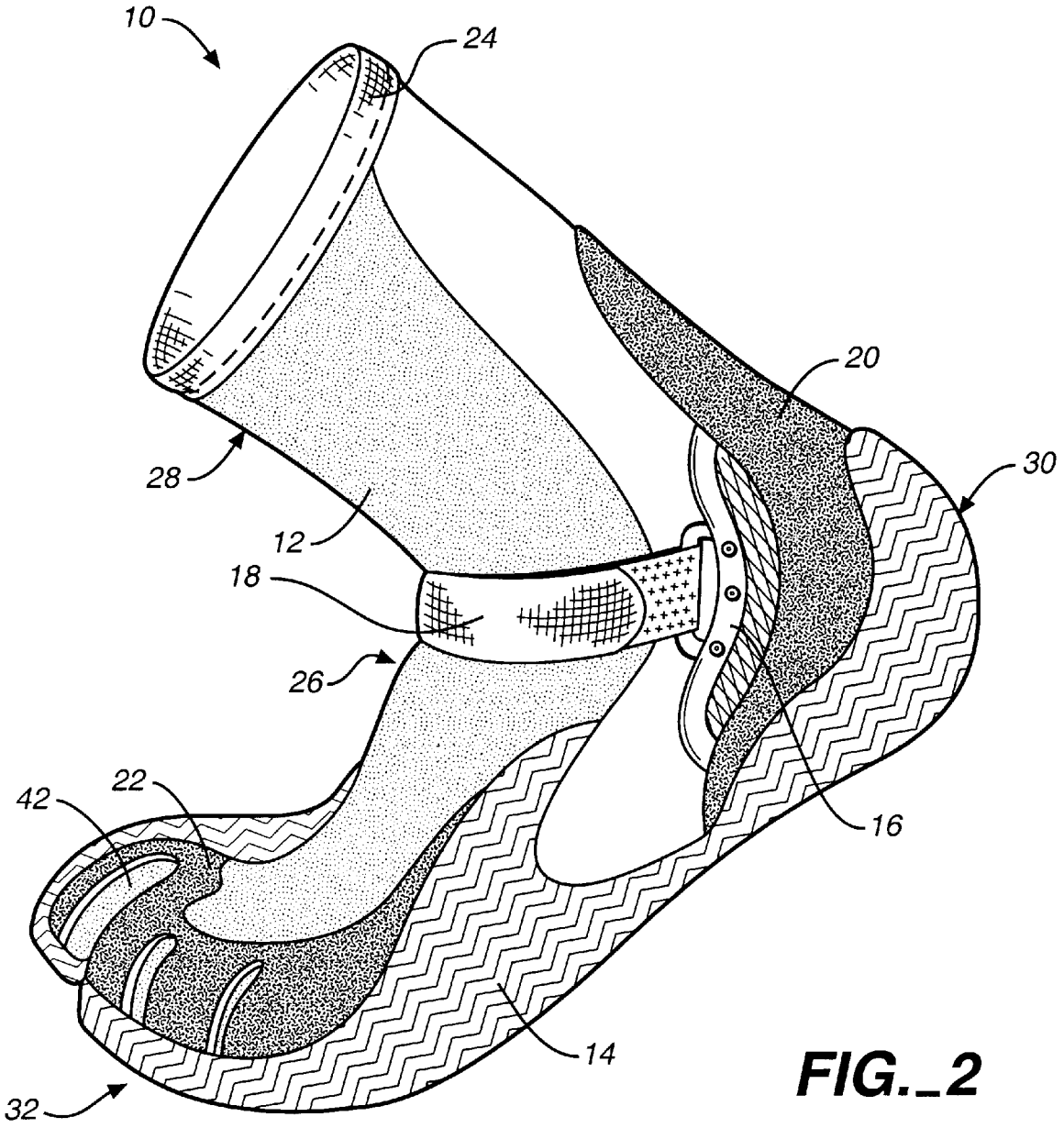
FIG. 2 is a pictorial view of the boot of FIG. 1, shown from the opposite side of the boot, and shown with the boot in forwardly-bent configuration, as it would be when person steps forward.

Referring to FIGS. 1 and 2, the present invention comprises a water sport boot 10 that includes a resiliently compressible, foamed elastomeric neoprene upper 12, a rubber sole pad 14, an netting heel cup 16, an adjustable strap 18, an achilles panel 20, a toe box foxing 22 and an elastic leg band 24. In referring to various parts of upper 12, reference will be made to an instep region 26, a collar region 28, a heel region 30 and a toe box region 32. Instep region 26 and collar region 28 generally are delineated by strap 18.

Figure 3:
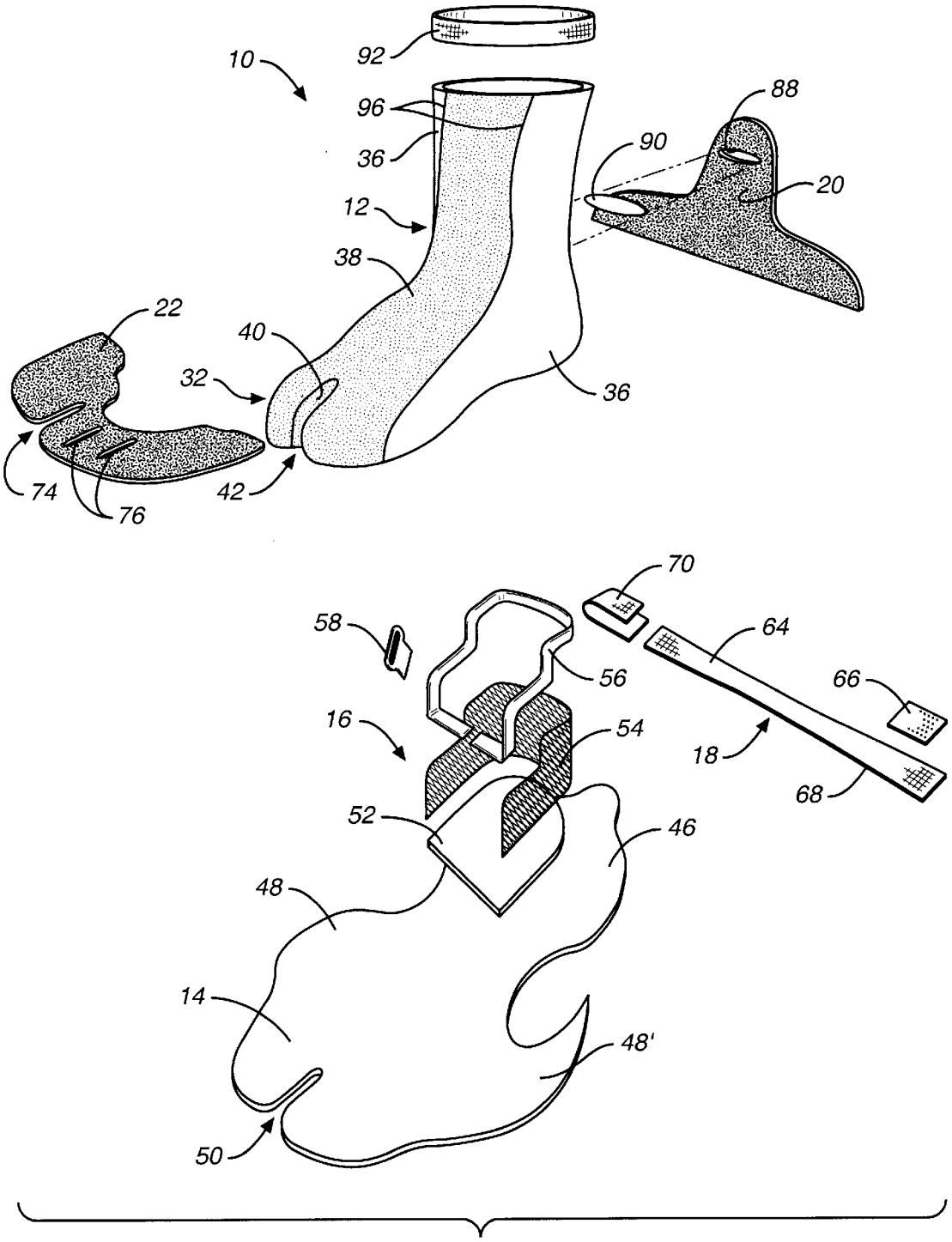
FIG. 3 is an exploded schematic pictorial view of the boot of FIG. 1, showing the various components used in assembling the boot.

Referring to FIG. 3, neoprene upper 12 is formed from three pieces of material—a first back and side edge piece 36, a second instep and sole piece 38 and a cut-out piece 40, which forms a cut-out 42 in the toe box 32 of upper 12. Cut-out 42 creates a pair of front pockets for receiving the toes of a person's foot. Preferably, cut-out 42 is positioned so that the big toe occupies one pocket and the remaining four toes occupy the other pocket. Cut-out piece 40 does not include additional padding material to protect piece 40 from abrasive wear and tear, as do some prior art boots. The omission of additional padding makes the boot slightly lighter in weight, which enhances performance. Pieces 36, 38, 40 are made from three millimeter thick, double lined neoprene and are adhesively seamed together and blind stitched to form a general "boot" shape. The neoprene pieces are double lined with nylon for comfort and appearance.

Sole pad 14 is sized larger than the footprint of upper 12 so that the side edges of sole pad 14 wrap upwardly around the sides of upper 12. Sole pad 14 is made from 30 shore natural "A" rubber and has formed on its exterior underside, as shown in FIGS. 1 and 2, a corrugated rib pattern for improving traction. Sole pad 14 includes back side extensions 46, only one of which can be seen in FIG. 3. Back side extensions 46 wrap upwardly around the heel region of upper 12. Sole pad 14 also includes front side extensions 48, one of which, extension 48', has a wave shape. Front side extensions 48 wrap upwardly around the front side edge portions of upper 12. FIGS. 1 and 2 show the extent to which side extensions 46, 48 wrap up the sides of upper 12. The wave shape of side extension 48' is provided to lengthen the side extension to allow it to wrap up and over the side of the upper, onto a portion of the top side of the upper. This provides traction on the top of the boot as well, which for some sports, such as surfing, is advantageous when performing certain maneuvers. A front cut-out 50 is provided in sole pad 14. Cut-out 50 is positioned to align with toe box cut-out 42 in upper 12.

The reason that scale pad 14 is made from a relative thin, light weight rubber material is because it is important that sole pad 14 be able to easily and quickly conform to the contour of the surface being stepped on. With a flexible and compressible sole pad, traction is increased as is tactile sensation because the soft sole pad quickly transmits tactile sensations to the person's foot. A stiff sole pad would tend to insulate parts of the foot from feedback. In general, traction and performance are increased when each part of the footprint of a foot, that is the heel, ball, toes, and lateral margin of the foot, can get a good feel for the surface being stepped on. In fact, traction and performance are further enhanced when each part of the different areas of the foot independently provide feedback. A soft, compressible sole pad allows a person to feel exactly what he or she is stepping on and exactly what that object or surface is doing, as would be the case if the person were barefoot.

Heel cup 16 includes a bottom netting panel 52 and a side netting panel 54. Preferably, the netting of panels 52, 54 is made from a durable nylon material having good tensile strength. A nylon edge tape 56 is stitched to the upper edge of side panel 54 and front edge of bottom panel 52. A sewable plastic D-ring 58 is sewn to edge tap 56.

Adjustable strap 18 includes an elongated band 64 that has formed along its inside surface hook and loop fasteners (not shown). A pull tab 66 is sewn at a free end 68 of band 64 to cover over the hook and loop fasteners at the free end and thereby provide a tab that is easily grabbed to fasten and release band 64. An elastic loop band 70 is looped around edge tape 56 and sewn to the edge tape and side netting panel 54, to secure adjustable strap 18 to one side of heel cup 16. Band 64 is designed to loop through the opening in D-ring 58 and wrap back upon itself so that the hook and loop fasteners on the inside of band 64 mechanically lock to secure adjustable strap 18 at a selected adjustment length. Elastic loop band 70 compensates for tendon expansion and allows the adjustable strap to adjust to various angles for different arch heights.

Heel cup 16 and adjustable strap 18 are designed to cooperate with one another to seal off the heel and ankle region of the upper. Heel cup 16 is adhesively bonded to upper 12, as discussed later, and transmits tension around the heel when adjustable strap 18 is tightened, to seal the heel region of upper 12 against a person's heel and ankle. In this manner, a tight seal can be made around the ankle to prevent water from entering the instep region and causing the foot to move within the boot.

Toe box foxing 22 is made from 50 shore natural rubber in order to provide protection in the toe box region 32 of upper 12. Toe box foxing 22 includes a cut-out 74, which corresponds to cut-out 42 in toe box region 32, and slits 76, which generally align with the gaps between a person's toes within the pockets formed in toe box region 32. Slits 76 are provided for increased flexibility and comfort in the toe box region. Toe box foxing 22 is adhesively secured to upper 12.

Achilles panel 20 includes an upper back extension 80 and a pair of lower side extensions 82. Achilles panel 20 is made from 60 shore natural rubber in order to provide adequate protection to a person's achilles tendon area from normal bangs and bumps encountered in water sport activities. Examples of normal bangs and bumps include banging into and landing on equipment and bumping into rocks. Achilles panel 20 is adhesively secured to upper 12 in a manner that sandwiches and secures heel cup 16 to upper 12. Achilles panel 20 also includes an oval cut-out 88 so that an embossed product identification panel 90 can be mounted to upper 12. Cut-out 88 and panel 90 are provided solely for cosmetic reasons.

An elastic leg band 92 is secured along the top edge 94 of upper 12. Leg band 92 preferably is made of stretch Lycra tape. Leg band 92 functions to prevent over-stressing of the seams 96 in upper 12 and also functions to grip a person's leg above the ankle, in order to prevent significant amounts of water from getting down into the collar region 28 of upper 12.

The performance sport boot described herein is specifically designed for surfers and should greatly aid surfers in gaining traction on their boards while performing various stunts, such as cut-backs, off-the-lips, floaters, aerials, and other types of maneuvers requiring enhanced board control. However, the performance sport boots of the present invention are not meant to be limited, necessarily, to the sport of surfing. On the contrary, the sport boots described herein should have utility in a variety of water sports and other water activities.

It should be understood that many changes, modifications, additions and deletions can be made to the boot described and shown herein without departing from the spirit and scope of the present invention, which is meant to be limited only by the following claims, when read and interpreted according to accepted legal principles such as the doctrine of equivalents and reversal of parts.

What is claimed is:

1. A performance water sport boot, comprising:

a resiliently compressible upper having an underside and side edge portions, the upper forming an instep region that conforms to a person's foot and ankle and a collar region that conforms to the person's lower leg, a sole pad mounted to the underside and side edge portions of the upper, the sole pad being made from a material that is less compressible than the upper's material, yet which has sufficient flexibility and compressibility to conform to the contour of an object being stepped on by the person and to transmit tactile sensations of the contour to the person's foot, a heel cup mounted around a heel portion of the upper, the heel cup extending around at least partially to the sides of the upper, and a strap extending above the instep region and adjustably secured to the sides of the heel cup in a manner sufficient to transmit tension around the heel and thereby closely tighten the heel cup around the heel and ankle of the person's foot, whereby the strap can be adjusted to tightly secure the upper around the person's heel and ankle and thereby prevent both a significant amount of water from sweeping into the instep region of the upper and the heel and ankle from moving within the boot.

2. The performance water sport boot of claim 1, wherein the sole pad's material is sufficiently flexible and compressible so that the heel, the ball, the lateral margin, and the toes of the person's foot each independently receive tactile sensations from the contour of the object being stepped on.

3. The performance water sport boot of claim 2, wherein the sole pad's material is sufficiently flexible and compressible so that different regions of the heel of the person's foot each independently receive tactile sensations from the contour of the object being stepped on, and different regions of the ball of the person's foot each independently receive tactile sensations from the contour of the object being stepped on, and different regions of the lateral margin of the person's foot each independently receive tactile sensations from the object being stepped on, and the toe pads of each the of the person's foot independently receive tactile sensations from the object being stepped on.

4. The performance water sport boot of claim 3, wherein the sole pad is made from a rubber-like material that has no greater than a 35 shore rating.

5. The performance water sport boot of claim 1, wherein the heel cup is made from a material having sufficient flexibility to conform to the heel of a person's foot, yet has sufficient tensile strength to be stretched sufficiently tight around the person's heel to prevent water from seeping into the instep region of the upper.

6. The performance water sport boot of claim 1, wherein the heel cup is made from a netting material.

7. The performance water sport boot of claim 1, wherein the adjustable strap includes hook and loop fasteners.

8. The performance water sport boot of claim 1, wherein the adjustable strap is fixedly secured to one side of the heel cup and is looped through the other side of the heel cup so that the strap can be easily adjusted and secured to tighten the upper around the person's heel and ankle.

9. The performance water sport boot of claim 8, wherein the adjustable strap has a free end and the adjustable strap includes a pull tab secured to the free end, to assist the person in adjusting the strap.

10. The performance water sport boot of claim 8, wherein the adjustable strap includes an elastic band for securing the adjustable strap to the heel cup.

11. The performance water sport boot of claim 1, and further comprising an achilles panel mounted to the back side of the upper and lower side edge portions of the upper, the achilles panel being made from a material significantly stronger than the sole pad, the achilles panel material providing protection to the person's achilles tendon from normal bangs and bumps encountered in water sport activities.

12. The performance water sport boot of claim 11, wherein the heel cup is at least partially sandwiched between the achilles panel and the upper, and the achilles panel is mounted to the upper in a manner allowing the heel cup to conform to the person's heel when the adjustable strap is tightened.

13. The performance water sport boot of claim 12, wherein the achilles panel is made from a rubber-like material having at least a 50 shore rating.

14. The performance water sport boot of claim 1, wherein the upper includes at least one cut-out in the toe box of the upper, to create a split toe box having separate pockets for receiving toes of the person.

15. The performance water sport boot of claim 14, wherein the sections of the upper forming the cut-out in the toe box are not padded with additional material, so that only the upper material separates the person's toes.

16. The performance water sport boot of claim 14, and further comprising a toe box foxing mounted over the toe box region of the upper, the toe box foxing being made from a material significantly stronger than the sole pad, which material provides protection to the person's toes from normal bumps encountered in water sport activities.

17. The performance water sport boot of claim 16, wherein the toe box foxing includes slits that generally align with the gaps between the person's toes, the slits giving the toe box foxing additional lateral flexibility for increased comfort.

18. The performance water sport boot of claim 16, wherein the toe box foxing is made from a rubber-like material having at least a 40 shore rating.

19. The performance water sport boot of claim 1, and further comprising an elastic leg band secured around the collar portion of the upper, to tightly grab the lower leg of the person.

20. The performance water sport boot of claim 1, wherein the resiliently compressible upper is made of a foamed elastomeric fabric.

21. The performance water sport boot of claim 1, wherein the strap is secured to the sides of the heel cup at a point sufficiently above the sole pad to transmit tension around the heel and thereby tighten the heel cup around a persons heel, when the strap is tightened over the instep region.

* * * * *